US008499513B2

(12) United States Patent
Jolly

(10) Patent No.: US 8,499,513 B2
(45) **Date of Patent: *Aug. 6, 2013**

(54) TOWER FOUNDATION

(71) Applicant: Tony Jolly, Houston, TX (US)

(72) Inventor: Tony Jolly, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/752,897

(22) Filed: Jan. 29, 2013

(65) Prior Publication Data

US 2013/0139453 A1 Jun. 6, 2013

Related U.S. Application Data

(60) Continuation-in-part of application No. 13/459,569, filed on Apr. 30, 2012, which is a division of application No. 12/317,063, filed on Dec. 18, 2008, now Pat. No. 8,220,213.

(60) Provisional application No. 61/008,742, filed on Dec. 21, 2007.

(51) Int. Cl.
*E02D 27/38* (2006.01)

(52) U.S. Cl.
USPC ..... 52/292; 52/298; 52/651.01

(58) Field of Classification Search
USPC ..... 52/292, 294–298, 745.04, 651.01, 52/831
See application file for complete search history.

(56) References Cited

U.S. PATENT DOCUMENTS

| | | | |
|---|---|---|---|
| D55,135 | S | 5/1920 | Maxwell |
| 1,366,179 | A | 1/1921 | Heckle |
| 3,803,855 | A | 4/1974 | Malkiel |
| 3,924,413 | A | 12/1975 | Marsh |
| 4,217,738 | A | 8/1980 | Smith |
| 4,218,859 | A | 8/1980 | Sams |
| 4,232,846 | A | 11/1980 | Bressani |
| 5,338,499 | A | 8/1994 | Ryynanen |
| 5,586,417 | A | 12/1996 | Henderson et al. |
| 5,826,387 | A | 10/1998 | Henderson et al. |
| 6,672,023 | B2 | 1/2004 | Henderson |
| 7,755,210 | B2 | 7/2010 | Kammer et al. |
| 2002/0194794 | A1 | 12/2002 | Hill et al. |
| 2003/0151260 | A1 | 8/2003 | Siegfriedsen |
| 2004/0111991 | A1 | 6/2004 | Swinimer |
| 2004/0154236 | A1 | 8/2004 | Kinzer |
| 2004/0226236 | A1 | 11/2004 | Pidgeon |
| 2006/0140761 | A1 | 6/2006 | LeMieux |
| 2007/0124025 | A1 | 5/2007 | Schram et al. |
| 2008/0217022 | A1 | 9/2008 | Deans |

FOREIGN PATENT DOCUMENTS

| | | |
|---|---|---|
| DE | 3707641 | 12/1987 |
| WO | 0236898 | 5/2002 |

OTHER PUBLICATIONS

USPTO Office Action dated Sep. 28, 2011 for parent U.S. Appl. No. 12/317,063.

*Primary Examiner* — Joshua J Michener
*Assistant Examiner* — Alp Akbasli
(74) *Attorney, Agent, or Firm* — D'Ambrosio & Menon, PLLC

(57) ABSTRACT

Tower foundations and structures, kits and methods for making the tower foundations. Aspects of the present invention operate to decouple the required mass for the foundation from the structural components needed to resist compression and tension forces. Aspects of the present invention include a foundation structure made of structural components including pre-cast concrete, cast-in place concrete, reinforced concrete, pre-stressed concrete, pre-tensioned concrete and post-tensioned concrete, for resisting the expected forces transferred from the tower.

15 Claims, 6 Drawing Sheets

TOWER FOUNDATION

PRIORITY CLAIM

This application is a continuation-in-part of U.S. application Ser. No. 13/459,569 filed Apr. 30, 2012, which is a division of U.S. application Ser. No. 12/317,063, filed Dec. 18, 2008, now issued as U.S. Pat. No. 8,220,213, which claims benefit of Provisional U.S. Patent Application No. 61/008,742 filed on Dec. 21, 2007, the entire disclosures of which are incorporated by reference herein.

FIELD OF THE INVENTION

A foundation for a tower.

BACKGROUND

Harnessing wind energy is becoming more widespread and acceptable as a viable means of generating electrical power for industrial and consumer uses. Large scale capture and conversion of wind energy requires the placement of wind turbines at a suitable elevation above the ground to capture the wind flow free from the interference and turbulence caused by the terrain surface. To achieve placement at such height, towers are used to support the wind turbines at the proper elevation. The towers are subjected to high winds that create tensile forces on the windward side of the tower and compression forces on the leeward side. These forces can be transferred to the foundation. Due to the small electrical generation capacity of each individual wind turbine, numerous towers are typically required.

SUMMARY

The typical method of constructing foundations for the wind turbine towers involves pouring a concrete base to support each of the towers. The concrete is poured into a plurality of forms containing tons of rebar. This requires the foundation be built at the construction site where it is subject to weather conditions, crew availability, and other factors which may lead to delay. Due to the fact construction of the foundations are often on the critical path for the project, any delays can impact project completion and have considerable negative financial consequences.

Costs and logistics for transporting concrete are high, and the wind turbines are often installed in remote areas where locally sourced concrete may not be available. Constructing tower foundations is usually carried out by setting up a cement batch plant at the construction site. This method of tower foundation construction still requires the transport of large amounts of water, dry cement, and rebar to the location, which increases construction costs.

Once constructed, it is very difficult to inspect the interior of the foundation and determine if any fatigue or corrosion damage is occurring. At the end of the project, it is difficult and expensive to remove the concrete foundations. If the foundation is left on the location, this results in ongoing legal exposure and site monitoring requirements. A substantial mass of concrete (reinforced with rebar) is required in typical foundations to stabilize the tower against lifting forces resulting from loads transferred from the tower to the foundation. Concrete has a large carbon footprint, which also may be detrimental to the environment.

Aspects of the present invention operate to decouple the required mass for the foundation from the structural components needed to resist compression and tension forces.

Aspects of the present invention include a foundation structure made of structural components comprising pre-cast concrete, cast-in place concrete, reinforced concrete, pre-stressed concrete, pre-tensioned concrete and post-tensioned concrete, for resisting the expected forces transferred from the tower. This foundation structure may be filled with non-cementitious materials a fill of any type to provide the required mass to stabilize the foundation and the tower. Avoiding the use of concrete, as fill material, to provide mass decreases the cost and carbon footprint of the tower. The fill may be soil or aggregate local to the tower site, increasing operational efficiency. Specific embodiments of the present invention may include a foundation structure, which is pre-fabricated or easily assembled from a kit. Aspects of the present invention thus enable foundations that can be constructed off of the critical path.

In one general aspect, a tower foundation structure is disclosed. The foundation structure includes a central shaft; a storage tank; and structural members comprising concrete with several possible implementations, including, pre-cast, cast-in place, reinforced, pre-stressed, pre-tensioned and post-tensioned, coupling the central shaft to the storage tank, the structural members comprising a top surface corresponding to the top surface of the peripheral shell and adjacent side surfaces, the side surfaces spanning the depth of the peripheral shell along the entire length of the structural members. The storage tank comprises one or more voids for containing non-cementitious fill as ballast to stabilize the central shaft. The total volume capacity of the voids may be at least a threshold volume. The threshold volume is a volume of a particular fill of a particular average density such that the weight of the volume of the particular fill is sufficient to counteract expected tension-based lifting forces. The structural members comprise a top surface corresponding to the top surface of the peripheral shell and adjacent side surfaces. The side surfaces span the depth of the peripheral shell along the entire length of the structural members. The structural members comprising concrete with several possible implementations, including, pre-cast, cast-in place, reinforced, pre-stressed, pre-tensioned and post-tensioned, may be configured to transfer compression loads and tension loads from the central shaft to the storage tank such that the transferred tension loads result in lifting forces on portions of the storage tank.

In specific embodiments, the storage tank comprises a bottom member including a top surface. The storage tank may also comprise a peripheral shell including a bottom surface, with the bottom surface being attached to the perimeter of the top surface of the bottom member. The bottom member may comprise material of sufficient strength and thickness to support at least the weight of the threshold volume of fill.

Other general aspects of the invention include a foundation comprising the foundation structure described above and a kit which may be assembled into the foundation structure, as well as methods for constructing a foundation and making the disclosed foundation structure.

BRIEF DESCRIPTION OF THE DRAWINGS

So that the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention relates to a system for constructing a modified mass foundation for a tower on site from prefabricated structural members comprising concrete with several possible implementations, including, pre-cast, cast-in place, reinforced, pre-stressed, pre-tensioned and post-tensioned, and using non-cementitious materials as fill to provide mass ballast for the foundation. The fill may be obtained locally to the construction site or from the construction site itself. In some instances, the fill may be obtained as a byproduct of the construction itself. To construct the tower foundation, a pit is excavated below the ground surface and the foundation structure is assembled inside the pit from pre-manufactured parts or positioned in the pit pre-assembled. In some implementations, the foundation structure is positioned on level ground, with no excavation required. Once the assembled foundation structure is in place, the foundation structure is at least partially filled with local fill materials to complete the foundation. The local materials may include, for example, backfill from the excavation of the pit.

Figure 1:
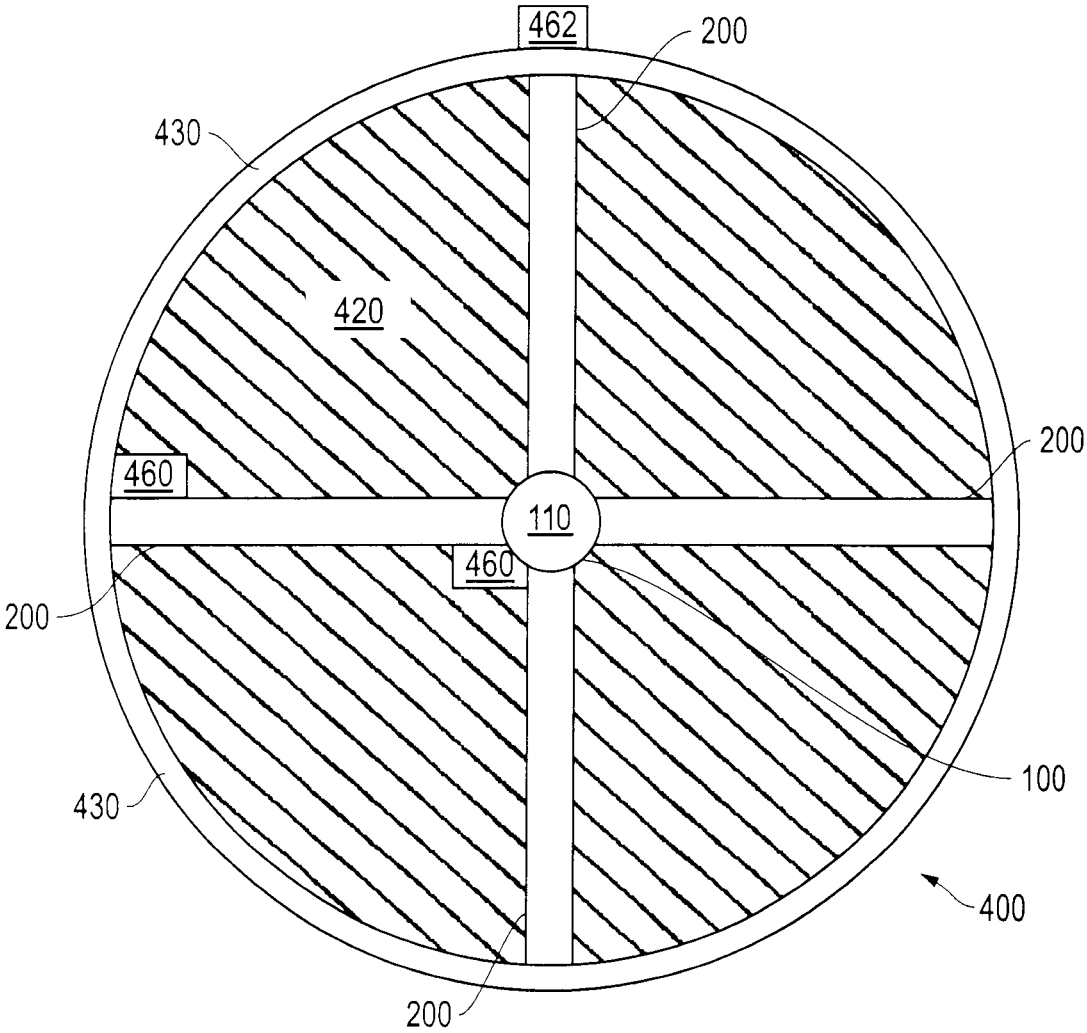
FIG. 1 is a top view of a foundation structure according to an embodiment of the invention.
Figure 2:
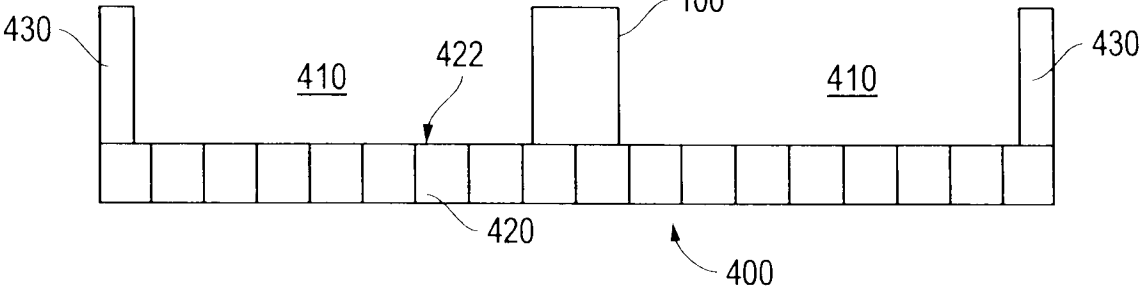
FIG. 2 is a cross sectional view of a foundation structure with voids of the foundation structure according to one or more embodiments of the invention.
Figure 3:
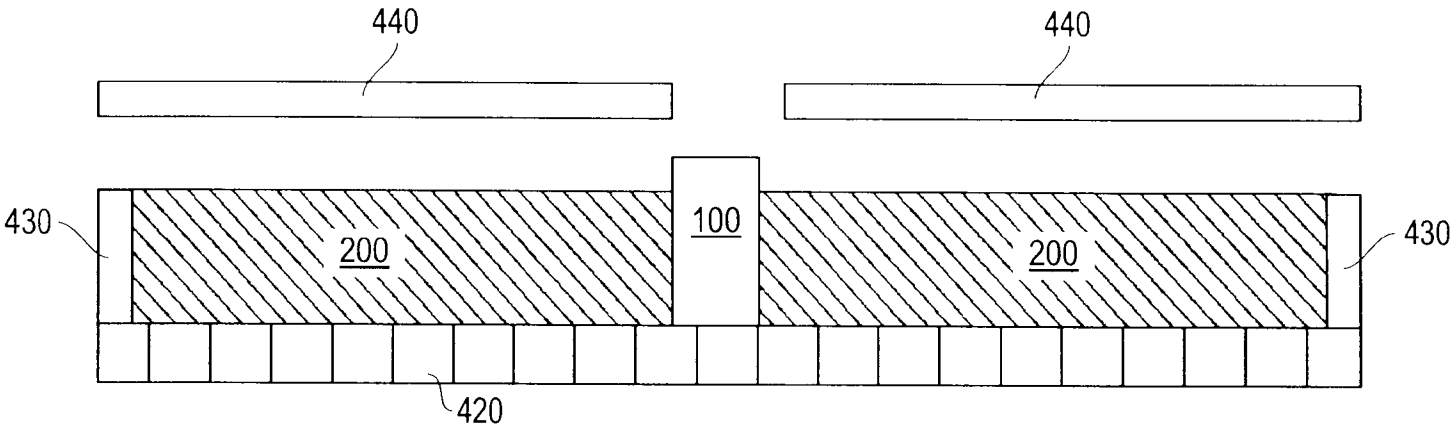
FIG. 3 is a cross sectional view of a foundation structure with structural members according to one or more embodiments of the invention.

Referring to FIGS. 1-3, the foundation structure is a vessel that provides structural strength while holding the mass required to stabilize the foundation structure with the tower mounted thereon. The foundation structure is constructed from a central shaft 100, a storage tank 400, and structural members 200, comprising concrete with several possible implementations, including, pre-cast, cast-in place, reinforced, pre-stressed, pre-tensioned and post-tensioned, coupling the central shaft 100 to the storage tank 400, the structural members 200 comprising a top surface corresponding to the top surface of the peripheral shell 430 and adjacent side surfaces, the side surfaces spanning the depth of the peripheral shell 430 along the entire length of the structural members 200. The central shaft 100 may be of a large enough diameter to match the tower to be mounted on the foundation structure and long enough to span the entire depth of the foundation structure. A fastening member 110 is located at the top of the central shaft for making the connection between the foundation structure and the base of the tower. Any suitable method or combination of methods for fastening the tower to the foundation may be used, including but not limited to: bolts, studs, welds, grouting, and/or threaded receivers.

Referring to FIGS. 1 and 3, a number of structural members 200 span radially from the central shaft 100 to the storage tank 400. In various embodiments, these structural members 200 may be made of concrete with several possible implementations, including, pre-cast, cast-in place, reinforced, pre-stressed, pre-tensioned and post-tensioned, steel plates, rods, I-beams, or other suitable material and may be placed in various numbers, groupings, and spacing depending on the required size of the foundation. The structural members 200 may be coupled to the central shaft 100 and the storage tank 400 by bolts, studs, welds, grouting, threaded receivers, and so on. The structural members 200 transfer compression loads and tension loads from the central shaft 100 to the storage tank 400.

Figure 4:
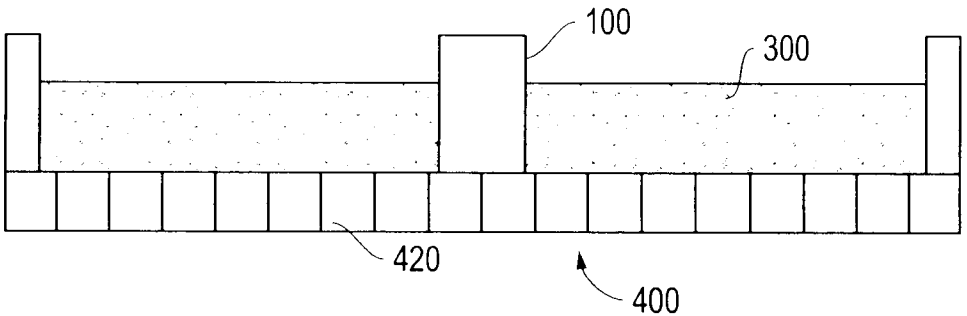
FIG. 4 is a cross sectional view of a foundation according to one or more embodiments of the invention.
Figure 5:
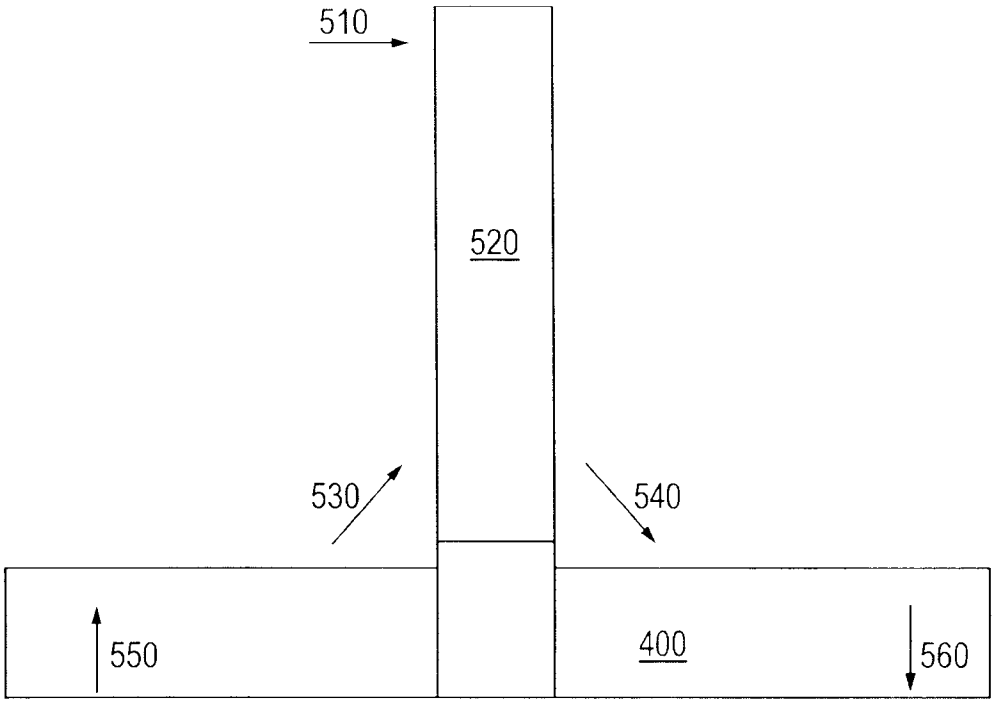
FIG. 5 is a force diagram of a tower coupled to a foundation according to one or more embodiments of the invention.

FIG. 5 illustrates typical loads on a tower connected to a foundation of the present disclosure. Referring to FIG. 5, winds apply a force 510 to the tower 520. The windward side of the tower bears a tensile load 530 and the leeward side of the tower bears a compression load 540. Structural members 200 in the foundation structure transfer the loads to the storage tank 400. Structural members 200 may comprise concrete with several possible implementations, including, pre-cast, cast-in place, reinforced, pre-stressed, pre-tensioned and post-tensioned. The transferred loads result in a lifting force 550 on the windward side of the storage tank 400 and a downward force 560 on the leeward side of the storage tank 400. The downward force 560 on the storage tank 400 is resisted by the earth underneath the storage tank 400. The lifting force 550 is resisted by the weight of storage tank 400 along with using non-cementitious materials as a fill 300, contained within the storage tank 400, as described below in FIG. 4.

Returning to FIG. 2, storage tank 400 comprises one or more voids 410. The voids 410 are configured to contain the fill 300 as ballast. In some embodiments, the total volume capacity of the voids 410 is at least a threshold volume. The threshold volume is a volume of fill of a particular average density such that the weight of the volume of fill is sufficient to counteract expected tension-based lifting forces, such as those resulting from high winds on the tower attached to the foundation. These expected tension-based lifting forces are a function of the height of the tower to be mounted and also the aerodynamic characteristics of the tower's particular shape in addition to the size and shape of the planned wind turbine generator and nacelle to be mounted on the tower. Thus, the threshold volume varies in dependence upon the density of the fill 300 to be used and in dependence upon the size and design of the tower 520. A first storage tank designed to be filled with hematite or barite would require less volume than another storage tank designed to be filled with gravel, because hematite and barite have a higher density. Thus, the threshold volume would be lower for the first storage tank. Tension force estimates for the tower 520 may be calculated according to height and general design. The weight of the fill 300 required to counteract the tension force estimates may then be calculated. In one example for a typical tower design, the weight of the fill 300 is set to equal the weight of the tower 520. The weight may be converted to a volume using the average density of the fill 300 (with a margin of safety added) to determine the threshold volume.

In FIGS. 1 and 2, the storage tank 400 includes bottom member 420 and peripheral shell 430. The peripheral shell 430 includes a bottom surface (not shown). The bottom surface of the peripheral shell 430 is attached to the perimeter of the top surface 422 of the bottom member 420. At the base of the storage tank 400 and the central shaft 100, a bottom member 420 serves as the base of the foundation. The bottom member 420 is a circular plate.

Referring to FIG. 3, structural members 200 may be made of concrete with several possible implementations, including, pre-cast, cast-in place, reinforced, pre-stressed, pre-tensioned and post-tensioned, and may span the depth of the peripheral shell 430 and couple the central shaft 100 to the peripheral shell 430. Structural members 200 also couple the central shaft 100 to the bottom member 420 of the storage tank. The central shaft 100 joins with the top surface 422 of the bottom member 420 to form the bottom of the foundation. The bottom member 420 comprises material, including concrete with several possible implementations, including, pre-cast, cast-in place, reinforced, pre-stressed, pre-tensioned and post-tensioned, of sufficient strength and thickness to support at least the weight of the threshold volume of fill. The storage tank may comprise an enclosed shell, including a top 440. The top 440 is flat ring comprised of one or more plates. The top 440 has a central cutout (not shown) which allows for the central shaft or the tower to pass through. The top 440 may be attached to the peripheral shell 430 and the central shaft 100. Any suitable method or combination of methods for fastening the top to the storage tank may be used, including but not limited to: bolts, studs, welds, grouting, and/or threaded receivers.

The storage tank 400 is shown to be approximately cylindrical. The storage tank 400 may be other shapes in other embodiments. The foundation structure may be any shape so long as the foundation has one or more voids 410 and is capable of supporting the tower. The particular shape of the storage tank in a specific embodiment is a result of particular design considerations. For example, a cylindrical shape may have desirable volume efficiency, while a rectangular shape may increase ease of manufacture and assembly. The bottom plate may be various shapes, such as rectangular, elliptical, or any other shape as will occur to those of skill in the art.

In some implementations, the central shaft 100 does not directly connect the bottom plate. Also, the structural members 200 comprising concrete with several possible implementations, including, pre-cast, cast-in place, reinforced, pre-stressed, pre-tensioned and post-tensioned, may couple the central shaft 100 to the top 440 of the storage tank 400. In some embodiments, the bottom member 420 varies in three dimensions (e.g., a basin shape).

The material used to make the foundation may be determined by the use and conditions surrounding the tower. In some aspects, the components of the foundation structure comprise steel, such as carbon steel or stainless steel. For example, the structural members 200 may comprise steel plates, rods, beams, concrete with several possible implementations, including, pre-cast, cast-in place, reinforced, pre-stressed, pre-tensioned and post-tensioned. Protective coatings may be applied to prevent corrosion. Other materials may be used in conjunction with steel. For example, in a location with large amounts of moisture in the soil a material that would not rust and would be resistant to water damage may be chosen to supplement steel, such as concrete or fiberglass. The material used to construct the foundation may be any combination of materials including, but not limited to, a metal, concrete, a composite (e.g., carbon structures), a ceramic, or a plastic. The fill 300 may be any particulate, such as, for example, soil or aggregate.

The foundation may include any number of sensors 460 adapted to detect conditions of and within the foundation. The sensors 460 may be positioned inside the foundation structure. For example, one or more sensors 460 may be placed within the foundation structure in order to detect the condition of the backfill and/or the material used to construct the foundation structure. Further, one or more sensors 462 may be placed on the exterior of the foundation in order to detect the condition of the soil surrounding the foundation and/or the material used to construct the foundation, including the foundation structure. Mechanical strain sensors and fatigue sensors may be placed in contact with portions of structural members 420 susceptible to high strain. The sensors 460 and 462 may include, but are not limited to, a mechanical strain sensor, a fatigue sensor, a moisture sensor, and a corrosion sensor (e.g., cathodic electrical potential sensors, etc.). The foundation may also include a cathodic protection system coupled to the foundation structure (not shown).

Referring to FIG. 4, once the foundation structure is positioned (for example, in the excavated pit), the voids 410 of the foundation structure are filled with the fill 300 to provide mass and ballast for the foundation. The fill 300 placed into the foundation structure may be, at least partially, comprised of local materials. The local materials may be from the excavation of the pit into which the foundation structure is placed. The type of fill 300 used will, therefore, depend on the local geology of the construction site. If the site is has a rock substrate, the fill 300 may consist of an aggregate, which may be cleaned and conditioned prior to placement in the foundation. If the site has a predominately soil substrate, the foundation may comprise the fill 300 consisting of local soils. Likewise, mixed substrates may produce the fill 300 comprising mixed rock and soil. This mixed substrate may be cleaned and conditioned prior to use. It will be appreciated that the fill 300 may be chosen from a range of possible materials that depends on the type of substrate found at the construction site.

Although existing traditional foundations are typically left in the ground after a site is decommissioned, aspects of the present invention disclosed herein allow easier cleanup and decommissioning of the site because the foundation structure may be removed cost-effectively. In some aspects, the foundation structure may be reused at another site. The ease of removal provided by aspects of the invention enable accurate evaluation of available wind power by providing a cost effective solution to install a full-sized tower and turbine at a site prior to full scale construction and cost-effective removal of the tower and foundation if turbine performance shows the available wind at the site is not suitable for full scale power production.

In another embodiment, the invention comprises a method for constructing a foundation for a tower. The foundation is constructed by excavating a pit of a sufficient size to contain the foundation structure. In some embodiments, the depth of the excavated pit is sufficient to contain the foundation structure with a top of the foundation structure located within plus or minus 3 feet of the ground surface. The backfill from the excavation may be reserved. In one embodiment, a foundation structure, such as that described above, is assembled inside the excavated pit from a kit including pre-fabricated pieces. In another embodiment, the foundation structure, such as the one above, is positioned in the pit at least partially pre-assembled. The partially (or entirely) pre-assembled foundation structure may be fabricated beforehand at a remote location for transport to the construction site, removing fabrication of these elements from the project's critical path. In some implementations (at construction sites with rocky ground or caliche-type soils, for example), the foundation structure is positioned on leveled ground with no excavation performed. Avoiding excavation could reduce costs, particularly in areas where excavation is problematic.

Any suitable method or combination of methods for fastening the components of the foundation may be used, including but not limited to: bolts, studs, welding, grouting, and/or threaded receivers. In one embodiment, the prefabricated pieces of the foundation structure are fitted together inside the excavated pit or on top of leveled ground at the site and are connected by bolting the pieces together with suitably sized threaded fasteners.

Construction of the foundation is continued by filling the storage tank 400 of the assembled foundation structure with the fill 300 to provide the mass and ballast to stabilize the foundation and the structure to be erected upon the foundation. The storage tank 400 may be filled with a volume of the fill 300 such that the weight of the volume of fill is sufficient to counteract expected lifting forces, as described above. The foundation structure may be filled with the backfill reserved from the excavation process. Construction of the foundation may also include enclosing the storage tank 400 after filling the storage tank with the fill 300. For example, the top 440 (described above with reference to FIG. 3) may be positioned and attached to the storage tank 400 after filling the storage tank.

Constructing the foundation according to aspects of the invention may take as little time as one to two days, in contradistinction with previous methods of tower construction in which tying rebar for the concrete foundation may take weeks. By minimizing the window for construction, weather delays are reduced. Also, the impact of cold, rain, and heat regarding pouring and curing cement are eliminated. Prefabrication of foundation elements also decreases costs by reducing the size of the required labor force at the site.

Figure 6A:
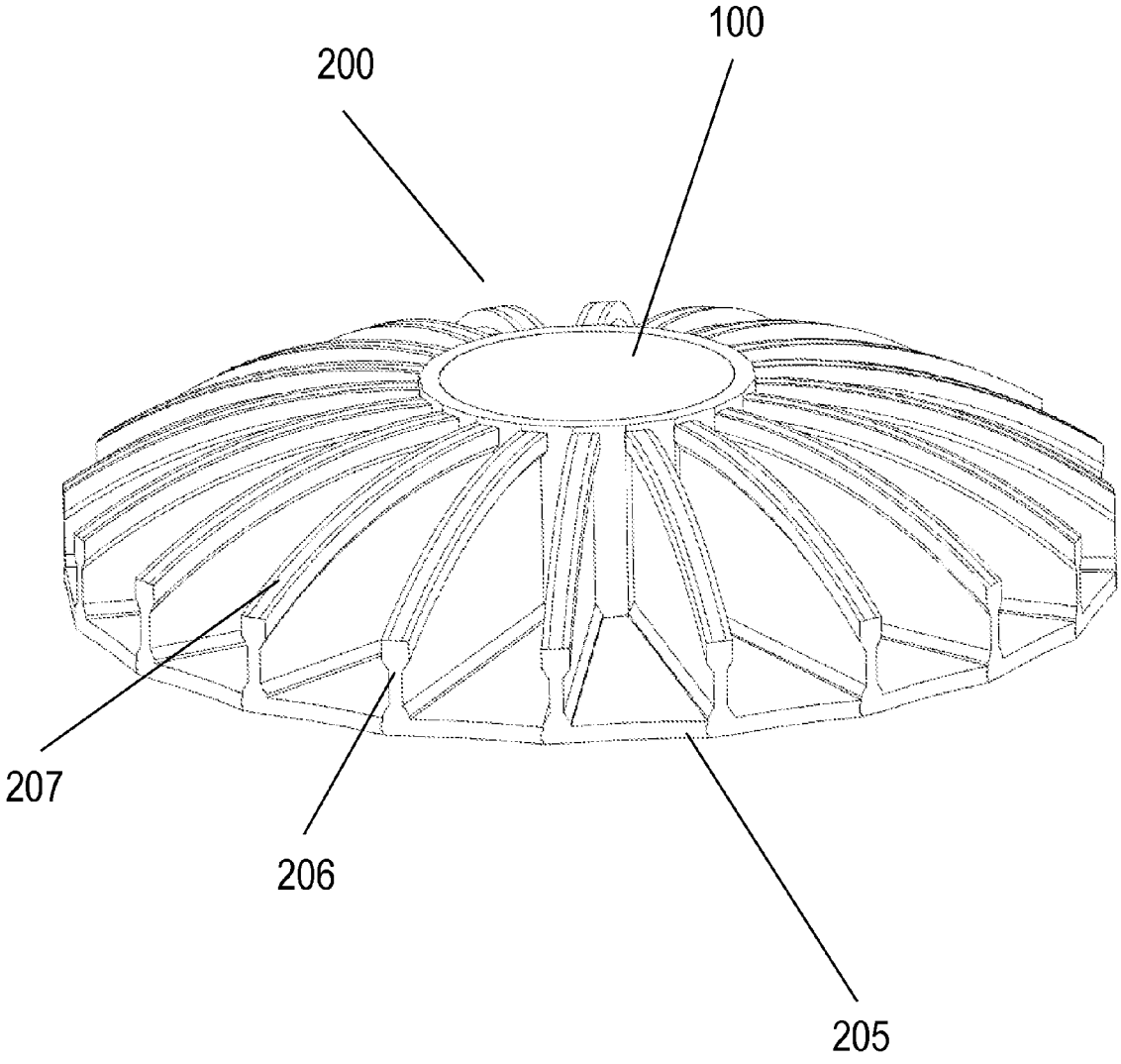
FIG. 6*a* is a perspective view of a foundation structure with structural members according to one or more embodiments of the invention.
Figure 6B:
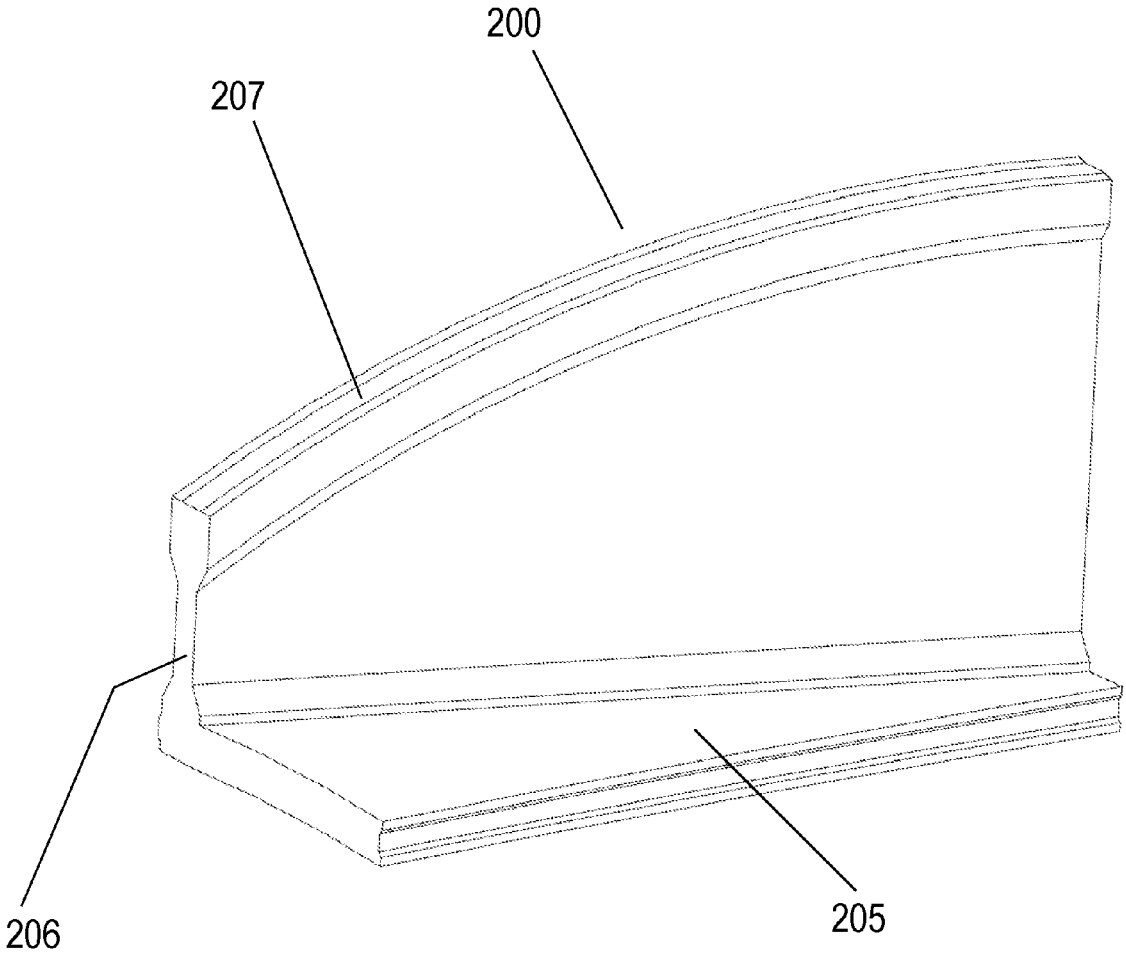
FIG. 6*b* is a cross sectional view of a structural member according to one or more embodiments of the invention.

Referring to FIGS. 6*a* and 6*b*, in one or more embodiments, the foundation structure has a central shaft 100 having a diameter to match a tower to be mounted on the foundation structure and a plurality of radially extending structural members 200 that couple the central shaft 100 to a bottom surface or base 205. Each structural member 200 comprises pre-cast concrete, cast-in place concrete, reinforced concrete, pre-stressed concrete, pre-tensioned concrete and post-tensioned concrete. The structural members 200 may be made of steel and/or concrete plates. The structural members 200 may have a substantially arched or curved top surface 207 integrally connected to the base 205 by a perpendicular member 206. In appropriate soil conditions, this foundation structure may be buried or placed in an excavated hole and covered with fill obviating the need for a storage tank.

Aspects of the present invention include a tower foundation structure kit. The foundation structure kit includes components for constructing the foundation structure discussed herein. The foundation structure kit includes one or more shaft components configured to be assembled as the central shaft 100. The kit also includes one or more storage tank components configured to be assembled as the storage tank 400 disposed proximate to the central shaft 100, with the storage tank 400 configured to the fill 300 as ballast to stabilize the central shaft 100. The storage tank components may include components for forming the peripheral shell 430, the bottom member 420 and the top 440, as described above. Components may be packaged in space-saving or easily handled configurations for storage and shipment. The kit also includes the structural members 200 comprising concrete with several possible implementations, including, pre-cast, cast-in place, reinforced, pre-stressed, pre-tensioned and post-tensioned, configured to be coupled to the central shaft 100 for transferring compression loads and tension loads from the central shaft 100 to the storage tank 400.

It should be understood that the inventive concepts disclosed herein are capable of many modifications. It is specifically contemplated that the scope of the present invention includes structural members other than those made with concrete, such as structural members made from reinforced and non-reinforced polymeric materials, composites, laminates, foamed concrete and other structural materials. Thus, the exemplary structural members disclosed hereinafter are not intended to be interpreted as unnecessarily limiting. Other modifications may include types of materials, specific tools and mechanisms used, and so on. To the extent such modifications fall within the scope of the appended claims and their equivalents, they are intended to be covered by this patent.

The invention claimed is:

1. A tower foundation structure comprising:

a central shaft having a diameter to match a tower to be mounted on the foundation structure;

a storage tank disposed proximate the central shaft, the storage tank comprising one or more voids for containing non-cementitious materials as fill as ballast to stabilize the central shaft, the storage tank further comprising a peripheral shell; and a plurality of radially extending structural members for coupling the central shaft to the peripheral shell, each structural member comprising pre-cast concrete, cast-in place concrete, reinforced concrete, pre-stressed concrete, pre-tensioned concrete and post-tensioned concrete, the structural members coupling the central shaft to the storage tank, the structural members comprising a top surface corresponding to the top surface of the peripheral shell and adjacent side surfaces, the side surfaces spanning the depth of the peripheral shell along the entire length of the structural members.

2. The foundation structure of claim 1 wherein a total volume capacity of the one or more voids is at least a threshold volume, the threshold volume comprising a volume of a particular fill of a particular average density such that the weight of the volume of the particular fill is sufficient to counteract expected tension-based lifting forces.

3. The foundation structure of claim 2 wherein the storage tank comprises a bottom member including a top surface, the bottom member comprising material of sufficient strength and thickness to support at least the weight of the threshold volume of fill.

4. The foundation structure of claim 3 wherein the peripheral shell comprises a bottom surface, the bottom surface attached to the perimeter of the top surface of the bottom member.

5. The foundation structure of claim 1 further comprising a fastening member located at the top of the central shaft, the fastening member connecting the foundation structure to the base of the tower.

6. The foundation structure of claim 4 wherein the structural members couple the central shaft to the bottom member of the storage tank.

7. The foundation structure of claim 1 wherein the structural members are coupled to the central shaft and the storage tank by at least one of the group consisting of bolts, studs, welds, grouting, and/or threaded receivers.

8. The foundation structure of claim 1 wherein the storage tank comprises an enclosed shell including a top.

9. The foundation structure of claim 8 wherein the structural members couple the central shaft to the top of the storage tank.

10. The foundation structure of claim 4 wherein the bottom surface comprises a steel and/or concrete plate.

11. The foundation structure of claim 1 wherein the structural members comprising a plurality of steel and/or concrete plates.

12. The foundation structure of claim 1 further comprising one or more sensors within the storage tank configured to detect a condition of the foundation.

13. The foundation structure of claim 12 wherein the one or more sensors comprises mechanical strain sensors, fatigue sensors, and/or corrosion sensors.

14. A tower foundation comprising:

the foundation structure of claim 1 positioned inside an excavated pit; and the volume of the fill such that the weight of the volume of the fill is sufficient to counteract an expected tension load transferred to the foundation structure from the tower.

15. The foundation of claim 14 wherein the depth of the excavated pit is sufficient to contain the foundation structure with a top of the foundation structure located within plus or minus 3 feet of the ground surface.

* * * * *